US009755305B2

(12) United States Patent
Desclos et al.

(10) Patent No.: US 9,755,305 B2
(45) Date of Patent: Sep. 5, 2017

(54) ACTIVE ANTENNA ADAPTED FOR IMPEDANCE MATCHING AND BAND SWITCHING USING A SHARED COMPONENT

(71) Applicant: Ethertronics, Inc., San Diego, CA (US)

(72) Inventors: Laurent Desclos, San Diego, CA (US); Chun Su Yoon, Seoul (KR); Sung-soo Nam, Gyeonggi-do (KR); M K Chun, Gyeonggi-do (KR); Ji-Chul Lee, Gyeonggi-do (KR)

(73) Assignee: Ethertronics, Inc., San Diego, CA (US)

( * ) Notice: Subject to any disclaimer, the term of this patent is extended or adjusted under 35 U.S.C. 154(b) by 295 days.

(21) Appl. No.: 14/314,559

(22) Filed: Jun. 25, 2014

(65) Prior Publication Data

US 2014/0306859 A1 Oct. 16, 2014

Related U.S. Application Data

(63) Continuation-in-part of application No. 14/200,012, filed on Mar. 6, 2014, now abandoned, which is a continuation-in-part of application No. 13/969,489, filed on Aug. 16, 2013, now abandoned.

(60) Provisional application No. 61/684,088, filed on Aug. 16, 2012.

(51) Int. Cl.

| | |
|---|---|
| ***H01Q 1/50*** | (2006.01) |
| ***H01Q 9/04*** | (2006.01) |
| ***H01Q 5/385*** | (2015.01) |
| ***H01Q 5/40*** | (2015.01) |

(52) U.S. Cl.

CPC ..... *H01Q 1/50* (2013.01); *H01Q 5/385* (2015.01); *H01Q 5/40* (2015.01); *H01Q 9/0421* (2013.01)

(58) Field of Classification Search

CPC ..... H01Q 5/385; H01Q 5/40; H01Q 1/50

See application file for complete search history.

(56) References Cited

U.S. PATENT DOCUMENTS

| | | | | |
|---|---|---|---|---|
| 7,675,469 | B2 * | 3/2010 | Ohba | H01Q 1/243 343/702 |
| 7,830,320 | B2 * | 11/2010 | Shamblin | H01Q 1/243 343/702 |
| 7,911,402 | B2 * | 3/2011 | Rowson | H01Q 1/243 343/700 MS |
| 9,160,074 | B2 * | 10/2015 | Desclos | H01Q 9/06 |
| 9,190,733 | B2 * | 11/2015 | Desclos | H01Q 7/005 |

* cited by examiner

*Primary Examiner* — Hoang Nguyen

(74) *Attorney, Agent, or Firm* — Coastal Patent Law Group, P.C.

(57) ABSTRACT

An active antenna and associated circuit topology is adapted to provide active impedance matching and band switching of the antenna using a shared tunable component. Using a shared tunable component, such as a tunable capacitor or other tunable component, the antenna provides a low cost and effective active antenna solution. In certain embodiments, one or more passive components can be further utilized to design band switching of the antenna from a first frequency to a second desired frequency.

18 Claims, 9 Drawing Sheets

ACTIVE ANTENNA ADAPTED FOR IMPEDANCE MATCHING AND BAND SWITCHING USING A SHARED COMPONENT

CROSS-REFERENCE TO RELATED APPLICATIONS

This application is a continuation in part of U.S. Ser. No. 14/200,012, filed Mar. 6, 2014;

which is a continuation of U.S. Ser. No. 13/969,489, filed Aug. 16, 2013;

which claims benefit of priority with U.S. Provisional Ser. No. 61/684,088, filed Aug. 16, 2012;

the contents of each of which are hereby incorporated by reference.

BACKGROUND OF THE INVENTION

Field of the Invention

This invention relates generally to the field of wireless communication; and more particularly, to an active antenna system adapted to utilize a shared tunable component for both active band switching and impedance matching for reduced component volume and efficient antenna operation.

Description of the Related Art

Current and future communication systems will require antenna systems capable of operation over multiple frequency bands. Efficiency improvements in the antenna system will be needed to provide better overall communication system performance, for example, increased antenna efficiency will translate into greater battery life in a mobile wireless device. For Multiple Input Multiple Output (MIMO) applications isolation between multiple antennas as well as de-correlated radiation patterns will need to be maintained across multiple frequency bands. Closed loop active impedance matching circuits integrated into the antenna will provide for the capability to dynamically impedance match the antenna for a wide variety of use conditions, such as the handset against the user's head for example. These and other requirements continue to drive a need for dynamic tuning solutions, such as active frequency shifting, active beam steering, and active impedance matching, such that antenna characteristics may be dynamically altered for improving antenna performance.

Commonly owned U.S. Pat. No. 7,911,402, issued Mar. 22, 2011, and titled "ANTENNA AND METHOD FOR STEERING ANTENNA BEAM DIRECTION", describes a beam steering technique wherein a single antenna is capable of generating multiple radiating modes; the contents of which are hereby incorporated by reference. In sum, this beam steering technique is effectuated with the use of a driven antenna and one or more offset parasitic elements that alter the current distribution on the driven antenna as the reactive load on the parasitic is varied. Multiple modes are generated, and thus this technique can be referred to as a "modal antenna technique", and an antenna configured to alter radiating modes in this fashion can be referred to as an "active multimode antenna" or "active modal antenna".

FIGS. 1(*a-c*) illustrate an example of an active modal antenna in accordance with the '402 patent, wherein FIG. 1*a* depicts a circuit board 11 and a driven antenna element 10 disposed thereon, a volume between the circuit board and the driven antenna element forms an antenna volume. A first parasitic element 12 is positioned at least partially within the antenna volume, and further comprises a first active tuning element 14 coupled therewith. The first active tuning element 14 can be a passive or active component or series of components, and is adapted to alter a reactance on the first parasitic element 12 either by way of a variable reactance, or shorting to ground, resulting in a frequency shift of the antenna. A second parasitic element 13 is disposed about the circuit board and positioned outside of the antenna volume. The second parasitic element 13 further comprises a second active tuning element 15 which individually comprises one or more active and passive components. The second parasitic element 13 is positioned adjacent to the driven element 10 and yet outside of the antenna volume, resulting in an ability to shift the radiation pattern characteristics of the driven antenna element by varying a reactance thereon. This shifting of the antenna radiation pattern can be referred to as "beam steering". In instances where the antenna radiation pattern comprises a null, a similar operation can be referred to as "null steering" since the null can be shifted to an alternative position about the antenna. In the illustrated example, the second active tuning element 15 comprises a switch for shorting the second parasitic to ground when "On" and for terminating the short when "Off". It should however be noted that a variable reactance on either of the first or second parasitic elements, for example by using a variable capacitor or other tunable component, may further provide a variable shifting of the antenna pattern or the frequency response. FIG. 1*b* illustrates a two-dimensional antenna radiation pattern associated with the modal antenna of FIG. 1*a*, wherein the pattern is shifted upon actively configuring the second parasitic element 13 from a first mode 16 to a second mode 17, or a third mode 18. FIG. 1*c* illustrates a typical frequency plot of the modal antenna of FIG. 1*a*, the frequency of the antenna can be shifted by actively configuring the first parasitic element 12 of the modal antenna. Here, a first frequency ($f_0$) of the antenna is achieved when the first and second parasitic elements are switched "Off"; the frequencies ($f_L$) and ($f_H$) are produced when the second parasitic is shorted to ground; and the frequencies ($f_4$; $f_0$) are produced when the first and second parasitic elements are each shorted to ground. Further details of this type of modal antenna can be understood upon a review of the '402 patent.

An early application identified for use with such active modal antennas includes a receive diversity application described in commonly owned U.S. patent application Ser. No. 13/674,137, filed Nov. 12, 2012, and titled "MODAL ANTENNA WITH CORRELATION MANAGEMENT FOR DIVERSITY APPLICATIONS", wherein a single modal antenna can be configured to generate multiple radiating modes to provide a form of switched diversity; the contents of which are hereby incorporated by reference. Certain benefits of this technique include a reduced volume required within the mobile device for a single antenna structure instead of a the volume required by a traditional two-antenna receive diversity scheme, a reduction in receive ports on the transceiver from two to one, and the resultant reduction in current consumption from this reduction in receive ports and associated conductive surfaces.

With Multiple Input Multiple Output (MIMO) systems becoming increasingly prevalent in the access point and cellular communication fields, the need for two or more antennas collocated in a mobile device or small form factor access point are becoming more common. These groups of antennas in a MIMO system need to have high, and preferably, equal efficiencies along with good isolation and low correlation. For handheld mobile devices the problem is exacerbated by antenna detuning caused by the multiple use cases of a device: hand loading of the cell phone, cell phone placed to user's head, cell phone placed on metal surface, etc. For both cell phone and access point applications, the multipath environment is constantly changing, which impacts throughput performance of the communication link.

Commonly owned U.S. patent application Ser. No. 13/289,901, filed Nov. 4, 2011, and titled "ANTENNA WITH ACTIVE ELEMENTS", describes an active antenna wherein one or multiple parasitic elements are positioned within the volume of the driven antenna. The impedance at the junction of the parasitic element and the ground plane is altered to effectuate a change in the resonant frequency of the antenna. For a driven antenna that is designed to contain multiple resonances at several frequencies, the multiple resonances can be shifted in frequency utilizing one or multiple parasitic elements. This results in a dynamically tunable antenna structure where the frequency response can be altered to optimize the antenna for transmission and reception over a wider frequency range than could be serviced by a passive antenna.

These and other active modal antenna techniques drive a need for a module or other circuit having active components for coupling with or integrated into the antenna. Such active components may include tunable capacitors, tunable inductors, switches, PIN diodes, varactor diodes, MEMS switches and tunable components, and phase shifters. Additionally, passive components may further be incorporated into such modules and other circuits for driving active antennas, whereas the passive components may include capacitors, inductors, and transmission lines with fixed and variable electrical delay for tuning the antenna. Additionally, there is a present and ongoing need for such active antennas adapted for band switching and impedance matching using fewer components such that costs and circuit volume can be reduced.

SUMMARY OF THE INVENTION

An active modal antenna is provided, the antenna being adapted for active band switching and impedance matching using a shared tunable component such that power requirements, manufacturing cost, and antenna volume are each reduced.

In an embodiment, an active modal antenna comprises a driven antenna element and at least one parasitic element positioned adjacent to the driven element, the driven element is coupled to an active matching circuit comprising a tunable component, and the parasitic element is coupled to the tunable component via a transmission line. In this regard, the tunable component is shared between the driven element and the parasitic element for simultaneously providing impedance matching and band switching capabilities.

In certain embodiments, one or more passive components may be further coupled to the parasitic element for tuning the frequency response of the antenna.

In various embodiments, a shared tunable component, such as a tunable capacitor, is utilized to provide both active band switching and impedance matching of an antenna.

DETAILED DESCRIPTION OF THE PREFERRED EMBODIMENTS

Figure 1A:
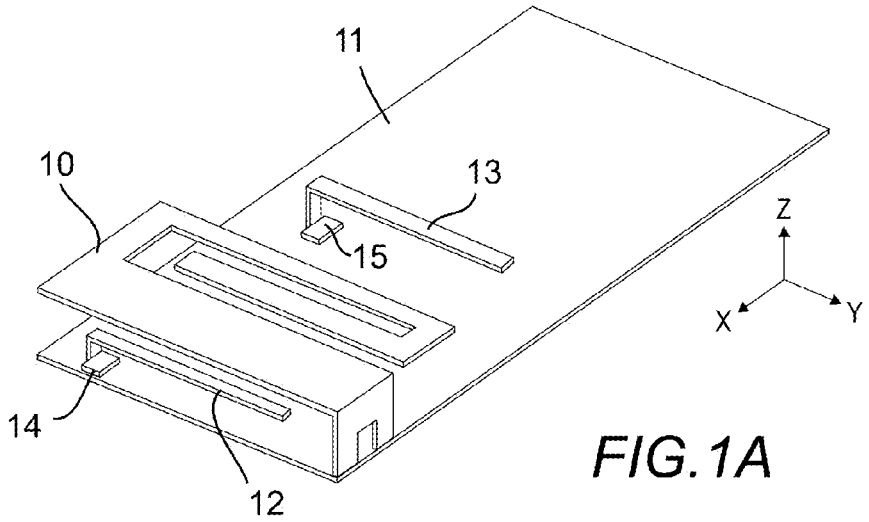
FIG. 1A shows an active modal antenna comprising a driven antenna element and a pair of adjacent parasitic elements coupled to active components for generating multiple antenna modes having distinct radiation patterns and frequency responses.
Figure 1B:
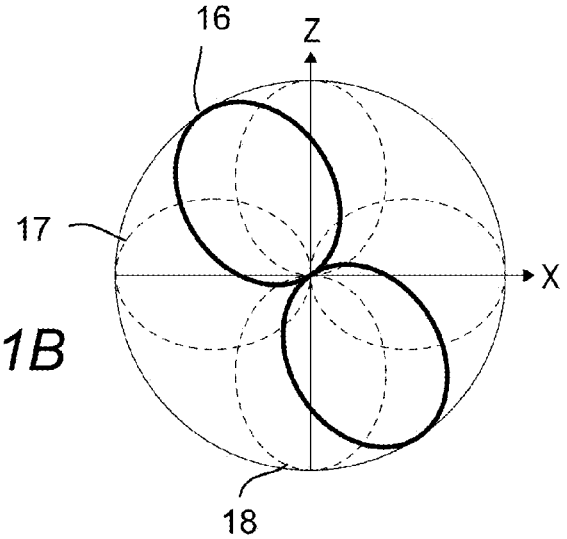
FIG. 1B shows multiple radiations patterns in two-dimensions resulting from the various modes of the antenna of FIG. 1A.
Figure 1C:
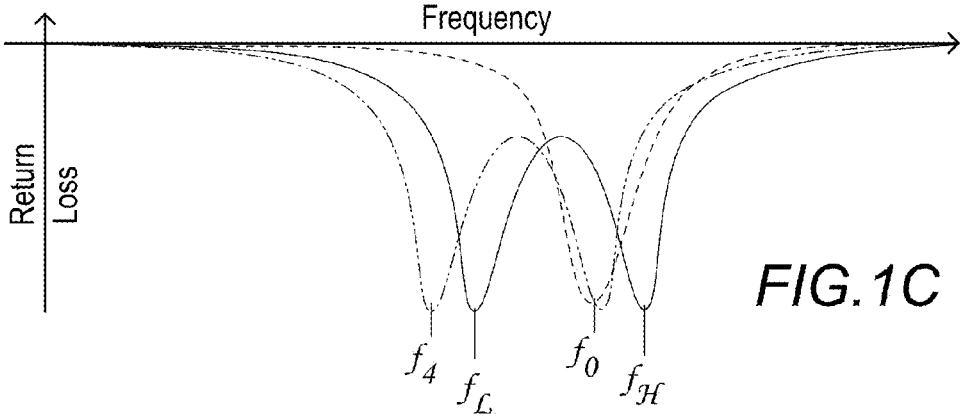
FIG. 1C shows a frequency plot characterized by the frequency response of the antenna of FIG. 1A at multiple modes.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment, an active modal antenna is adapted for active band switching and impedance matching using minimal componentry by incorporating a shared tunable component capable of providing a tunable reactance for effectuating each of the antenna matching and band switching functions.

In an embodiment, an active modal antenna comprises a driven antenna element positioned above a circuit board and forming an antenna volume therebetween. A first parasitic element is positioned adjacent to the driven antenna element. The driven element is coupled to a matching circuit comprising one or more active or passive components. The matching circuit further comprises a first tunable component. The parasitic element is coupled to the first tunable component of the matching circuit via a transmission line. In this regard, the first tunable component functions to impedance match the driven element and to shift the frequency of the modal antenna by providing a reactance to the parasitic element.

With little experimentation and testing, the tunable component can be engineered to result in a first frequency shift by producing a first tunable reactance, and a second frequency shift by producing a second tunable reactance that is distinct from the first tunable reactance. Other factors for use in the antenna design may include: length of the radiating and parasitic conductors, size of antenna ground, and other known factors.

Now turning to the drawings, detailed examples are provided in order to further enable those having skill in the art to make and use the invention, however, it should be understood that deviations from these examples may be performed without departing from the spirit and scope of the invention. Accordingly, the illustrated examples are not intended to limit the scope of the invention as set forth in the appended claims.

The following examples illustrate antennas comprising an isolated magnetic dipole (IMD) antenna element. Such an IMD element is known in the art to provide improved isolation and reduced coupling of the antenna radiator with nearby componentry. In a general description, the IMD antenna includes an inductive loop portion and a capacitive gap across the inductive loop portion, such that the antenna radiator comprises an LC type structure with both an inductive loop formed by current traveling through the conductor and a capacitance formed by current coupling from a first conductor to a second conductor element across the capacitive gap. Reference is made to commonly owned U.S. Pat. No. 6,456,243, issued Sep. 24, 2002, titled "MULTIFREQUENCY MAGNETIC DIPOLE STRUCTURES AND METHODS FOR REUSING THE VOLUME OF AN ANTENNA"; the contents of which are hereby incorporated by reference. Because this invention utilizes passive and active components, it may be preferable to use an IMD type antenna as the driven antenna element; however, in certain applications it may be possible to utilize other driven elements, including but not limited to: wire conductors, planar inverted f-type antennas, loops, patches, and other conductors. Accordingly, the active modal antennas herein may be practiced with a variety of driven antenna elements; however it may be preferred to utilize such an IMD structure for its inherent benefits.

Figure 2A:
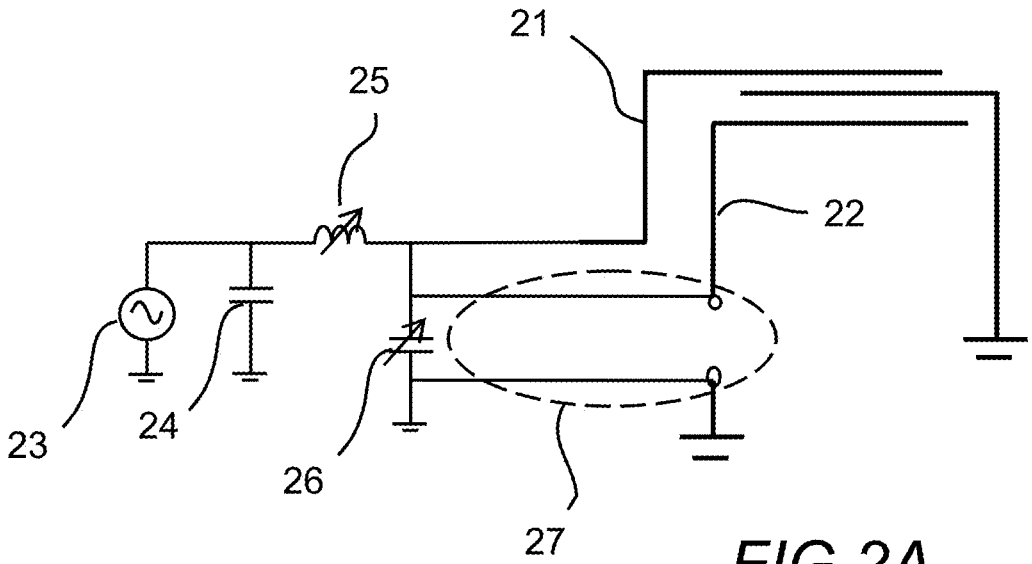
FIG. 2A shows a driven antenna element and an adjacent parasitic element, the driven element is coupled to a matching circuit having a tunable component, and the parasitic element is further coupled to the tunable component via transmission lines.

FIG. 2A illustrates a technique which provides dual use of a tunable capacitor. In FIG. 2A, a driven antenna element 21 is coupled to signal 23 through a matching circuit comprising passive components such as a capacitor 24 and active components such as a tunable inductor 25. The matching circuit is further adapted to comprise a tunable capacitor 26 for actively matching the impedance of the antenna. A parasitic element 22 is positioned adjacent to the driven element 21. The parasitic element is further coupled to the tunable capacitor 26 via transmission lines 27.

In this example, the tunable capacitor 26 is attached to the matching circuit in a shunt configuration; a transmission line is connected across the ends of the tunable capacitor, with the opposing end of the transmission line connected to portions of a parasitic element positioned beneath an IMD antenna. The tunable capacitor, when connected in this fashion, will provide the capability of altering the impedance of the matching circuit connected to the feed point of the IMD antenna while simultaneously altering the impedance loading of the parasitic element, which will in turn adjust the frequency response of the IMD antenna.

Figure 2B:
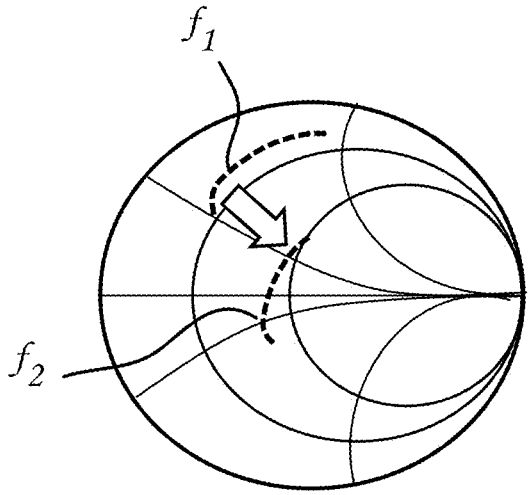
FIG. 2B shows a resultant frequency shift in the antenna of FIG. 2A, wherein the frequency can be shifted from a first frequency ($f_1$) to a second frequency ($f_2$).

FIG. 2B illustrates a resultant frequency shift in the antenna, wherein the frequency can be shifted from a first frequency ($f_1$) to a second frequency ($f_2$). This frequency shifting technique is a result of a change in impedance of the adjacent parasitic element, and is also herein referred to as "band switching".

Figure 2C:
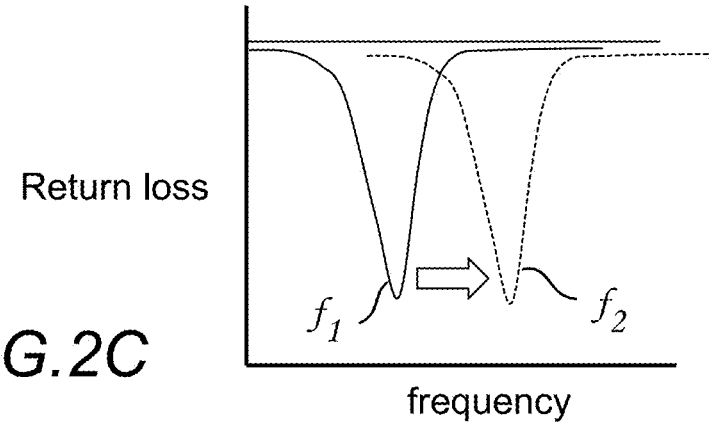
FIG. 2C shows a frequency plot illustrating the resulting frequency shift of FIG. 2B, whereas the first frequency ($f_1$) is shifted to a higher frequency ($f_2$).

FIG. 2C further illustrates the resulting frequency shift, whereas the first frequency ($f_1$) is shifted to a higher frequency ($f_2$).

Figure 3A:
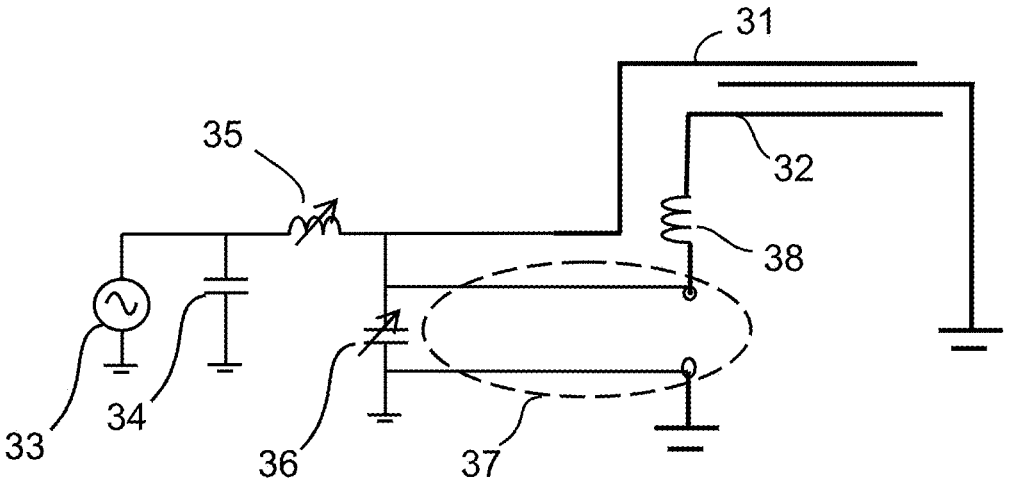
FIG. 3A shows a driven antenna element and an adjacent parasitic element, the driven element is coupled to a matching circuit having a tunable component, and the parasitic element is further coupled to the tunable component via transmission lines; the parasitic element is further couple to an inductor for reversing a direction of the resulting frequency shift.

FIG. 3A illustrates the technique shown in FIGS. 2A-2C with the addition of an inductor 38 at the junction of the transmission line and the parasitic element beneath the IMD antenna. The addition of an inductor of the proper value provides the capability of shifting the frequency response of the IMD antenna in an opposite fashion compared to the antenna configuration shown in FIG. 2(A-C), or from a higher frequency to a lower frequency as shown.

As illustrated in FIG. 3A, an active modal antenna comprises a driven antenna element 31 and a parasitic element 32 positioned adjacent to the driven element. The driven antenna element 31 is further coupled to a signal feed 33 through a matching circuit comprising a tunable inductor 35 and one or more passive components, such as a capacitor 34. The matching circuit is further coupled to a tunable capacitor for varying a capacitive reactance generated therefrom. The parasitic element 32 is coupled to the tunable capacitor 36 via transmission lines 37. Additionally, the parasitic element is coupled to an inductor 38 for shifting the frequency response of the antenna from a higher first frequency ($f_3$) to a lower second frequency ($f_4$).

Figure 3B:
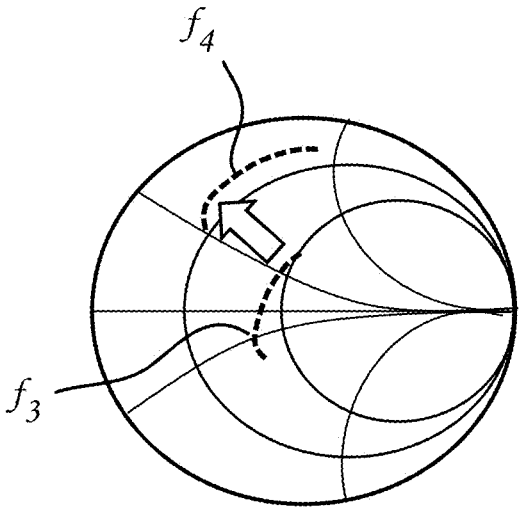
FIG. 3B shows a resultant frequency shift in the antenna of FIG. 2A, wherein the frequency can be shifted from a higher frequency ($f_3$) to a lower frequency ($f_4$).

FIG. 3*b* illustrates a resultant frequency shift in the antenna, wherein the frequency can be shifted from a higher frequency ($f_3$) to a lower frequency ($f_4$).

Figure 3C:
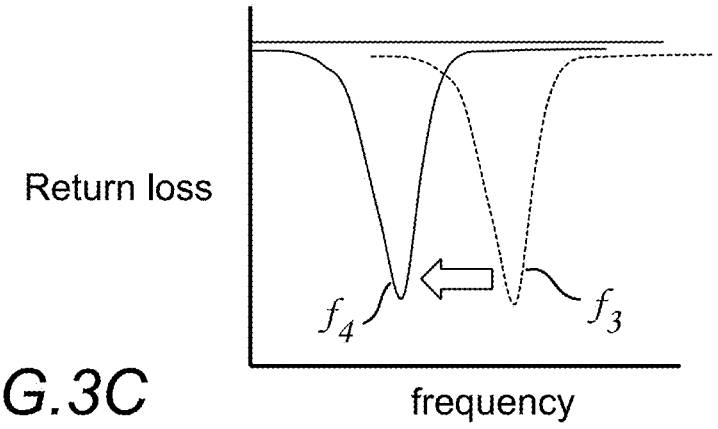
FIG. 3C shows a frequency plot illustrating the resulting frequency shift of FIG. 3B, whereas the higher frequency ($f_3$) is shifted to a lower frequency ($f_4$).

FIG. 3*c* further illustrates the resulting frequency shift in a two dimensional plot, whereas the higher frequency ($f_3$) is shifted to a lower frequency ($f_4$).

Figure 4A:
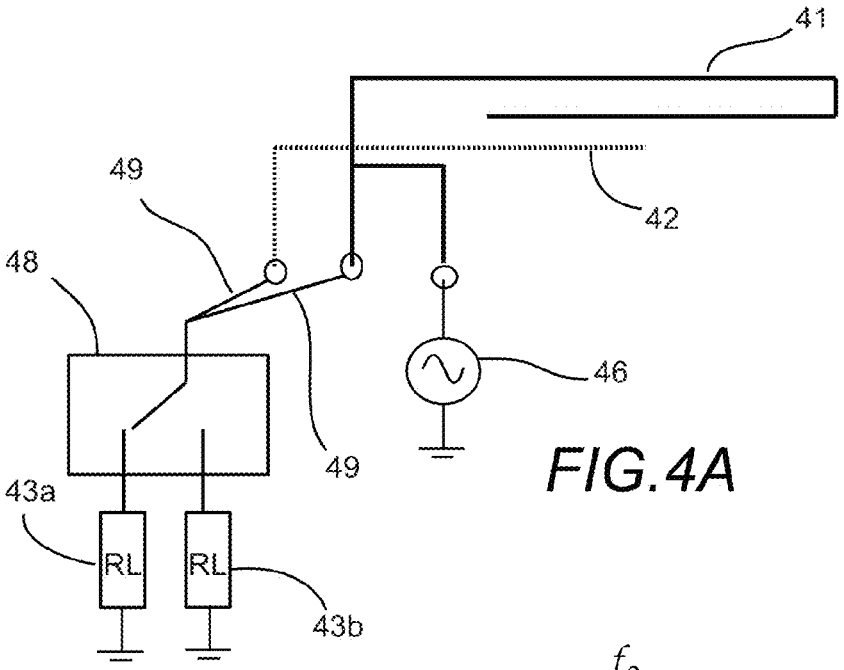
FIG. 4A shows an antenna element and a parasitic element positioned adjacent to the antenna element; a two port switch is used to connect the parasitic element and the ground leg of the antenna to ground.

FIG. 4A shows a driven antenna element 41 and a parasitic element 42 positioned adjacent therewith. The antenna element 41 comprises a ground leg and a feed leg, the feed leg is coupled to feed 46. Each of the ground leg of the antenna element 41 and the parasitic element 42 is coupled to a switch via transmission lines 49 extending therebetween. A two port switch 48 is used to connect the parasitic element 42 and a ground leg of the antenna to ground. The parasitic element and the ground leg of the antenna are connected to the common port of the switch. Reactive loads 43*a*; 43*b* are attached to the two switch ports to effect a change in frequency. The result of this configuration is to shift the frequency response of the antenna while simultaneously matching the impedance of the antenna.

Figure 4B:
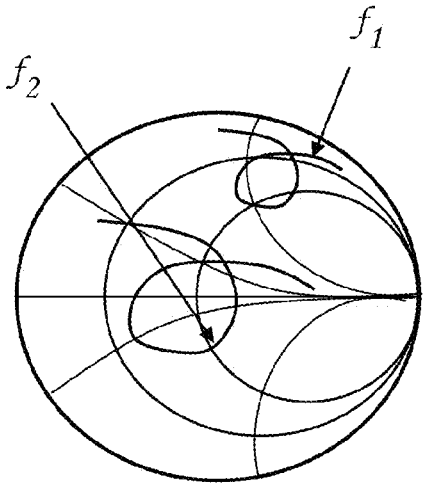
FIG. 4B illustrates a frequency shift of the antenna of FIG. 4A in various modes.

FIG. 4B shows the antenna frequency response from a first frequency ($f_1$) to a second frequency ($f_2$) caused by switching between the two switch ports and various reactive loads.

Figure 4C:
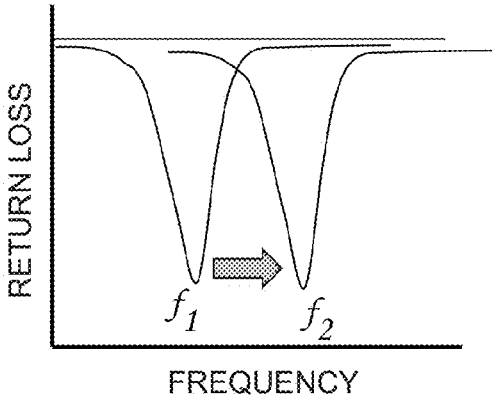
FIG. 4C shows a frequency plot illustrating the resulting frequency shift of FIG. 4B.

FIG. 4C further illustrates the resulting frequency shift in a two dimensional plot, whereas the higher frequency ($f_1$) is shifted to a lower frequency ($f_2$).

Figure 5A:
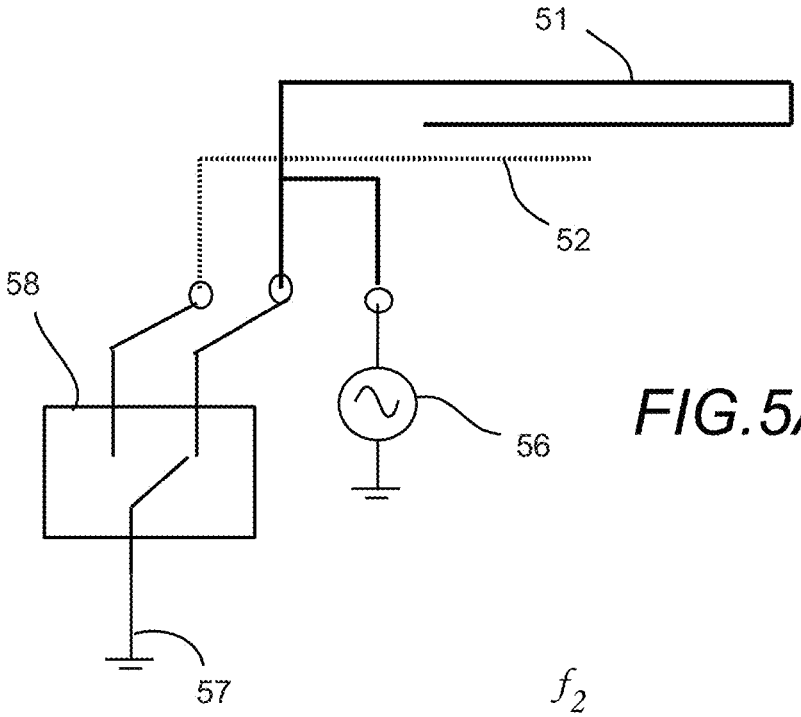
FIG. 5A shows an antenna element and a parasitic element positioned adjacent to the antenna element; a two port switch is used to connect the parasitic element or the ground leg of the antenna to ground using the common port of the switch.

FIG. 5A describes a driven antenna element 51, and a parasitic element 52 positioned adjacent to the driven antenna element. The antenna element 51 comprises a ground leg and a feed leg, the feed leg is coupled to feed 56. Each of the ground leg of the antenna element 51 and the parasitic element 52 is coupled to respective switching ports of a switch via transmission lines 59 extending therebetween. The two port switch 58 is used to connect one of the parasitic element 52, or the ground leg of the antenna 51, to ground 57, whereas the switch is coupled to ground using the common port of the switch. The result of this configuration is to shift the frequency response of the antenna while simultaneously matching the impedance of the antenna.

Figure 5B:
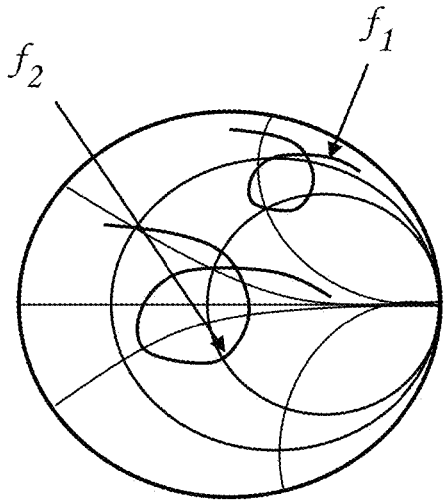
FIG. 5B illustrates a frequency shift of the antenna of FIG. 5A in various modes.

FIG. 5B shows the antenna frequency response from a first frequency ($f_1$) to a second frequency ($f_2$) caused by switching between the two switch ports and various reactive loads.

Figure 5C:
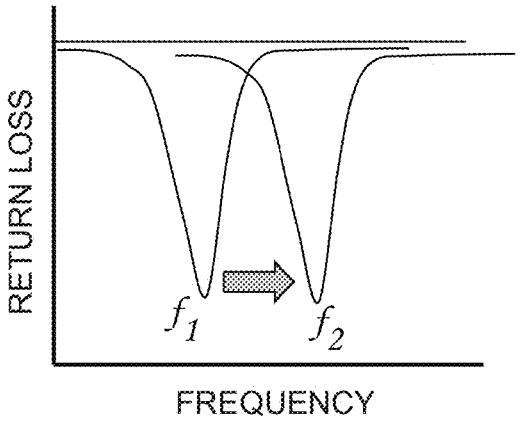
FIG. 5C shows a frequency plot illustrating the resulting frequency shift of FIG. 5B.

FIG. 5C further illustrates the resulting frequency shift in a two dimensional plot, whereas the higher frequency ($f_1$) is shifted to a lower frequency ($f_2$).

Figure 6A:
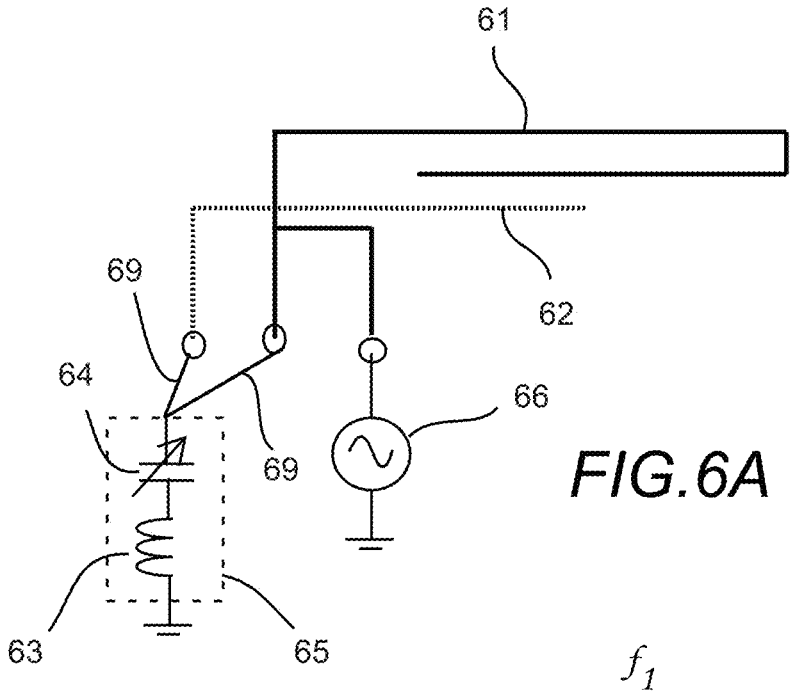
FIG. 6A shows an antenna element and a parasitic element positioned adjacent to the antenna element; a tunable LC circuit is formed by attaching a tunable capacitor to an inductor and used to connect the parasitic element and the ground leg of the antenna to ground.

FIG. 6A shows a driven antenna element 61, and a parasitic element 62 positioned adjacent to the driven antenna element. The antenna element 61 comprises a ground leg and a feed leg, the feed leg is coupled to feed 66. A tunable LC circuit 65 is formed by attaching a tunable capacitor 64 to an inductor 63. The tunable LC circuit 65 is used to connect each of the parasitic element 62 and the ground leg of the antenna 61 to ground. The parasitic element and the ground leg of the antenna are commonly connected to a first end of the LC circuit. A second end of the LC circuit 65 is attached to ground.

Figure 6B:
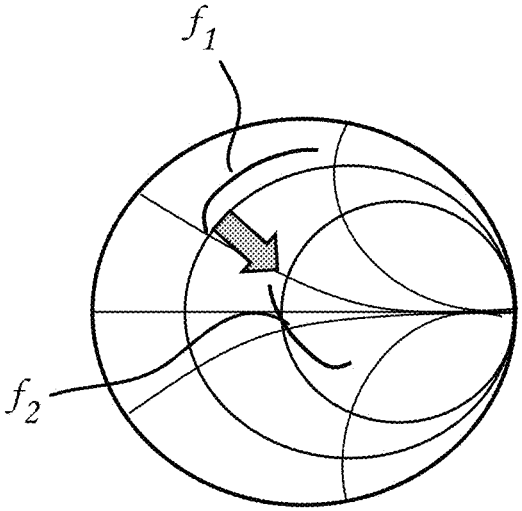
FIG. 6B illustrates a frequency shift of the antenna of FIG. 6A in various modes.

FIG. 6B shows the antenna frequency response from a first frequency ($f_1$) to a second frequency ($f_2$) caused by switching between the two switch ports and various reactive loads.

Figure 6C:
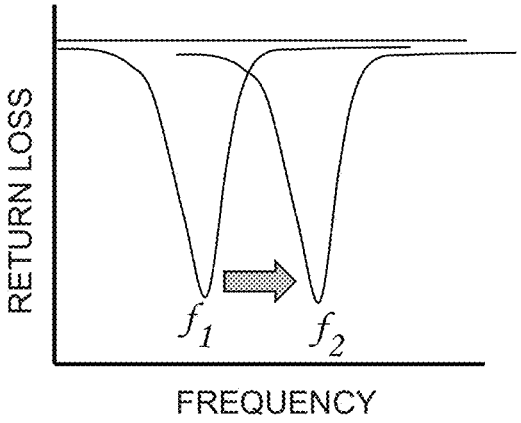
FIG. 6C shows a frequency plot illustrating the resulting frequency shift of FIG. 6B.

FIG. 6C further illustrates the resulting frequency shift in a two dimensional plot, whereas the higher frequency ($f_1$) is shifted to a lower frequency ($f_2$).

Figure 7A:
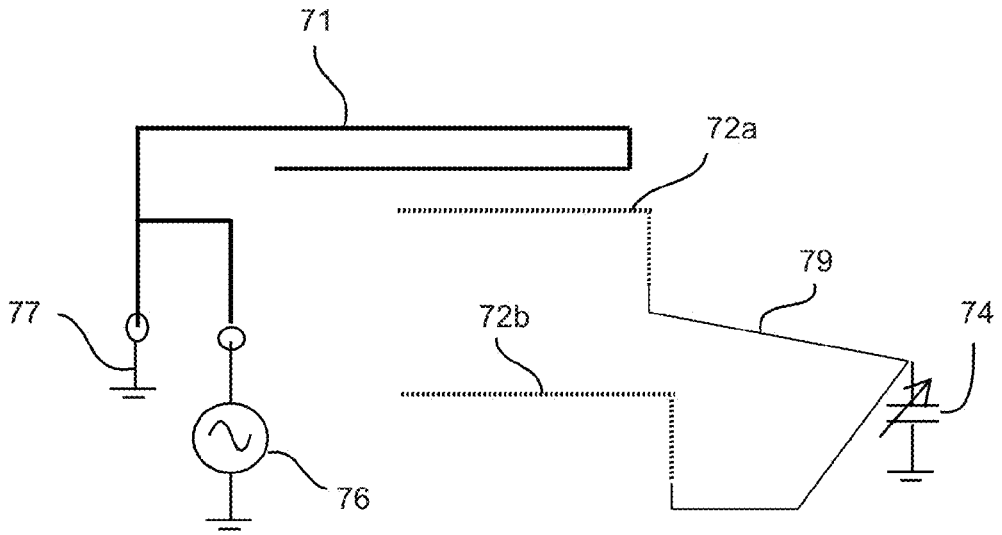
FIG. 7A illustrates an antenna along with two parasitic elements, one parasitic element positioned beneath the antenna to alter the frequency response of the antenna, and the second parasitic positioned offset to the antenna and used to alter the radiation pattern of the antenna; wherein a tunable capacitor is connected or coupled to both parasitic elements and is used to simultaneously alter the frequency response and radiation pattern of the antenna.

FIG. 7A illustrates a driven antenna element 71 and two parasitic elements 72*a*; 72*b* positioned adjacent therewith. The driven antenna element 71 comprises a ground leg coupled to ground 77, and a feed leg coupled to feed 76. A first parasitic element 72*a* is positioned beneath the driven antenna element 71, or within a volume between the driven antenna element and a circuit board, to alter the frequency response of the antenna. A second parasitic element 72*b* is positioned offset to the driven antenna element 71, or outside of the antenna volume, and used to alter the radiation pattern of the antenna. A tunable capacitor 74 is coupled to both the first and second parasitic elements via transmission lines 79 extending therebetween, and is used to simultaneously alter the frequency response and radiation pattern of the antenna.

Figure 7B:
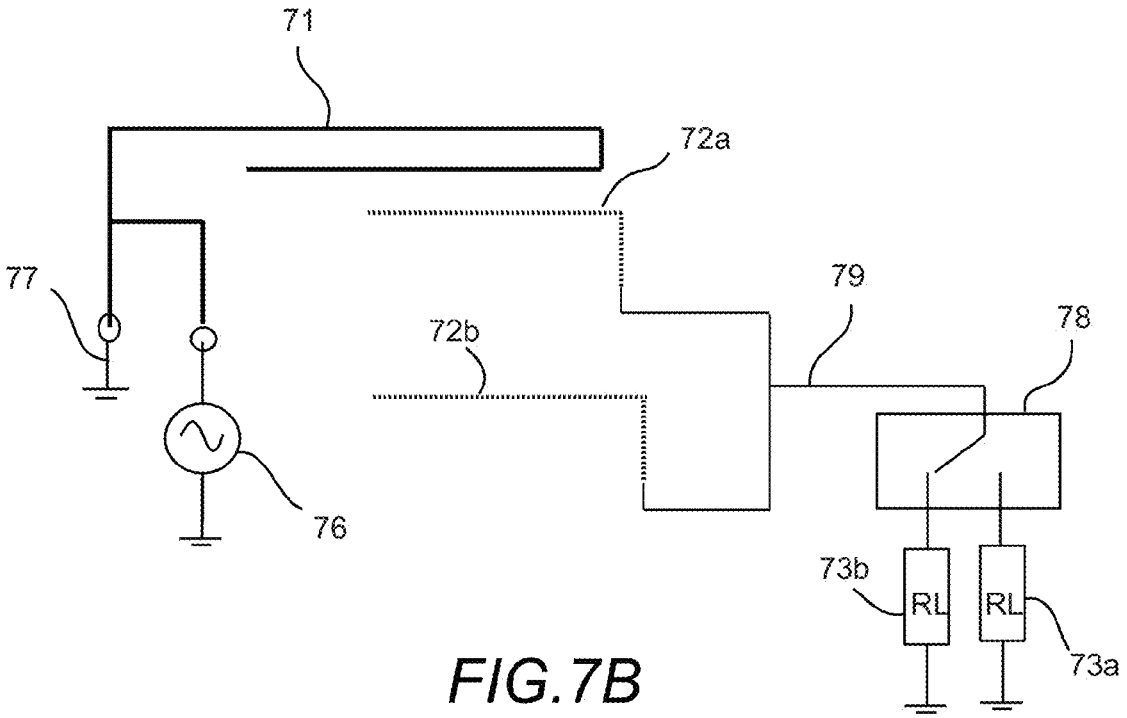
FIG. 7B illustrates an antenna along with two parasitic elements, one parasitic element positioned beneath the antenna to alter the frequency response of the antenna, and the second parasitic positioned offset to the antenna and used to alter the radiation pattern of the antenna; wherein the common port of a two port switch is connected or coupled to both parasitic elements and is used to simultaneously alter the frequency response and radiation pattern of the antenna. Reactive loads are attached to the two switch ports to effect a change in frequency.

FIG. 7B illustrates a driven antenna element 71 and two parasitic elements 72*a*; 72*b* positioned adjacent therewith. The driven antenna element 71 comprises a ground leg coupled to ground 77, and a feed leg coupled to feed 76. A first parasitic element 72*a* is positioned beneath the driven antenna element 71, or within a volume between the driven antenna element and a circuit board, to alter the frequency response of the antenna. A second parasitic element 72*b* is positioned offset to the driven antenna element 71, or outside of the antenna volume, and used to alter the radiation pattern of the antenna. The common port of a two port switch 78 is connected or coupled to both parasitic elements 72*a*; 72*b* and is used to simultaneously alter the frequency response and radiation pattern of the antenna. Reactive loads 73*a*; 73*b* are attached to the two switch ports to effect a change in frequency.

Figure 8:
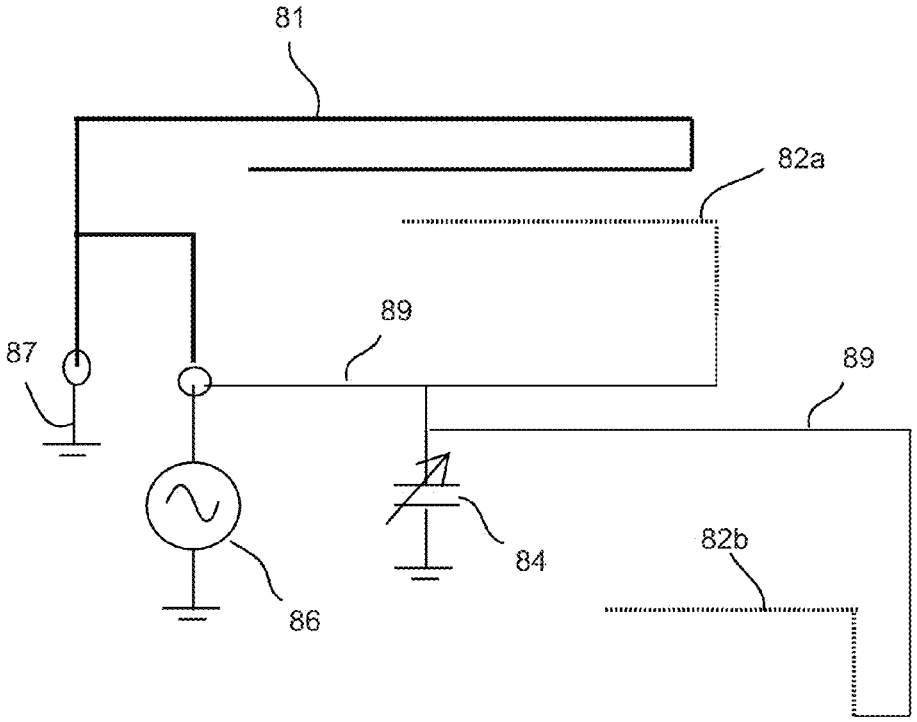
FIG. 8 illustrates an antenna along with two parasitic elements, one parasitic element positioned beneath the antenna to alter the frequency response of the antenna, and the second parasitic positioned offset to the antenna and used to alter the radiation pattern of the antenna. A tunable capacitor is connected to both parasitics and is connected to the feed point of the antenna and is used to impedance match, alter the frequency response, and alter the radiation pattern simultaneously.

FIG. 8 illustrates a driven antenna element 81 and two parasitic elements 82*a*; 82*b* positioned adjacent therewith. The driven antenna element 81 comprises a ground leg coupled to ground 87, and a feed leg coupled to feed 86. A first parasitic element 82*a* is positioned beneath the driven antenna element 81, or within a volume between the driven antenna element and a circuit board, to alter the frequency response of the antenna. A second parasitic element 82*b* is positioned offset to the driven antenna element 81, or outside of the antenna volume, and used to alter the radiation pattern of the antenna. A tunable capacitor 84 is connected to both parasitic elements 82*a*; 82*b* via various transmission lines, and is further connected to the feed point of the driven antenna element 81 via transmission line 89. The tunable capacitor 84 is used to impedance match, alter the frequency response, and alter the radiation pattern simultaneously.

Figure 9:
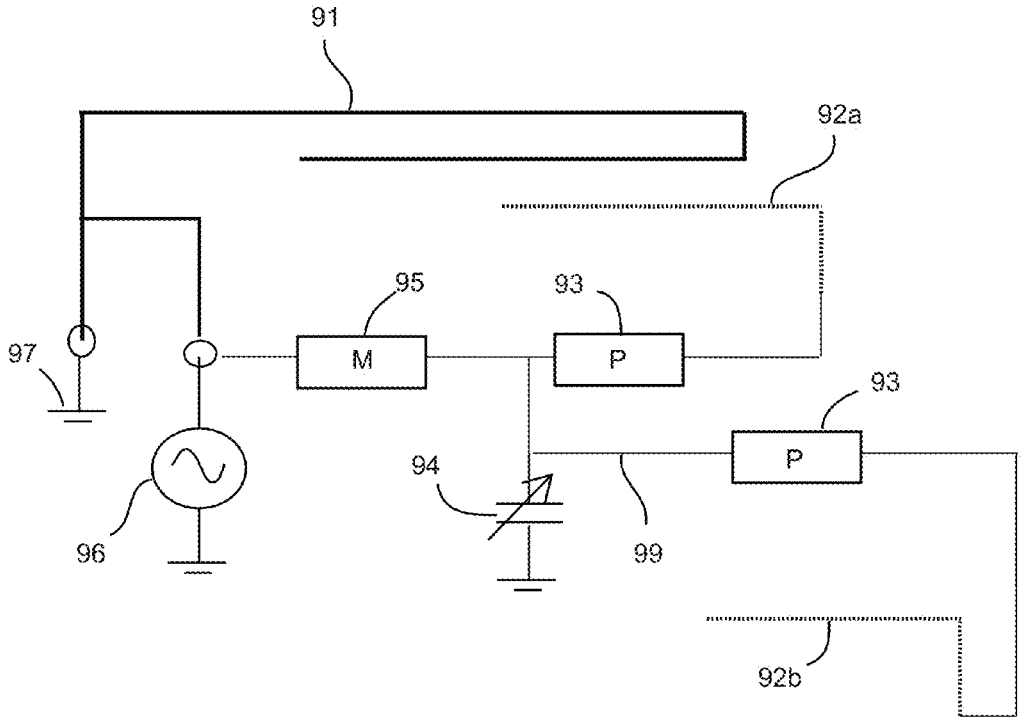
FIG. 9 illustrates an antenna with two parasitic elements positioned adjacent therewith, a first of the parasitic elements is positioned beneath the antenna to alter the frequency response of the antenna, and a second of the parasitic elements is positioned offset to the antenna and used to alter the radiation pattern of the antenna. A tunable capacitor is connected to both parasitic elements and is connected to the feed point of the antenna such that the tunable capacitor is used to impedance match, alter the frequency response, and alter the radiation pattern, simultaneously. A matching circuit is added to the feed point of the antenna to aid in matching the antenna. Phase compensation circuits are connected to the parasitic elements to compensate for the electrical delay between the tunable capacitor and the parasitic elements.

FIG. 9 illustrates a driven antenna element 91 and two parasitic elements 92*a*; 92*b* positioned adjacent therewith. The driven antenna element 91 comprises a ground leg coupled to ground 97, and a feed leg coupled to feed 96. A first parasitic element 92*a* is positioned beneath the driven antenna element 91, or within a volume between the driven antenna element and a circuit board, to alter the frequency response of the antenna. A second parasitic element 92*b* is positioned offset to the driven antenna element 91, or outside of the antenna volume, and used to alter the radiation pattern of the antenna. A tunable capacitor 94 is connected to both parasitic elements 92*a*; 92*b* via various transmission lines 99, and is further connected to the feed point of the driven antenna element 91 via a transmission line. The tunable capacitor 94 is used to impedance match, alter the frequency response, and alter the radiation pattern simultaneously. A matching circuit 95 is added to the feed point of the antenna to aid in matching the antenna. The matching circuit is disposed between the tunable capacitor 94 and the feed leg of the antenna. A pair of phase compensation circuits 93, including a first phase compensation circuit and a second phase compensation circuit, are provided. Each of the phase compensation circuits is coupled between a respective parasitic element 92*a*; 92*b* and the tunable capacitor 94 to compensate for the electrical delay between the tunable capacitor and the parasitic elements.

Additional passive components, such as inductors, capacitors, and resistors may be incorporated within the matching circuit or otherwise with the antenna conductors. Moreover, additional active components, such as variable capacitors, MEMS device, tunable inductors, switches, diodes, and other components may be utilized. In this regard, the above examples illustrate a number of topologies for producing an active modal antenna adapted for active band switching and impedance matching using a shared component. However, hose having skill in the art will recognize a myriad of variations which can be accomplished to produce a similar result. Accordingly, the examples herein shall not limit the scope of the invention as set forth in the appended claims.

What is claimed is:

1. An active modal antenna adapted for impedance matching and band switching using a shared component, the antenna comprising:

a driven antenna element; and at least one parasitic element positioned adjacent to the driven antenna element;

the driven antenna element being coupled to a matching circuit;

characterized in that:

each of the matching circuit and the parasitic element are further coupled to a tunable component via transmission lines extending therebetween;

wherein the tunable component is adapted to alter a reactance of each of the matching circuit and the parasitic element for effectuating active band switching and impedance matching of the antenna.

2. The antenna of claim 1, wherein the tunable component comprises a tunable capacitor.

3. The antenna of claim 1, said matching circuit further comprising one or more passive components individually selected from: a resistor, capacitor, or an inductor.

4. The antenna of claim 1, said matching circuit further comprising one or more active components individually selected from: a tunable capacitor, MEMS device, tunable inductor, switch, or a diode.

5. The antenna of claim 1, said at least one parasitic element being further coupled to an inductor for enabling band switching from a first higher frequency to a second lower frequency, wherein said first higher frequency is higher than said second lower frequency.

6. The antenna of claim 1, said driven antenna element comprising:

an isolated magnetic dipole (IMD) antenna element positioned above a circuit board forming an antenna volume therebetween; and said at least one parasitic element comprising:

a first parasitic element positioned adjacent to said IMD antenna element and within said antenna volume, and a second parasitic element positioned adjacent to the IMD antenna element and outside of the antenna volume.

7. An active modal antenna adapted for impedance matching and band switching using a shared component, the antenna comprising:

a driven antenna element; and at least one parasitic element positioned adjacent to the driven antenna element;

characterized in that:

the driven antenna element coupled to a matching circuit comprising a first tunable component; and each of the driven antenna element and the at least one parasitic element coupled to a second tunable component;

wherein the antenna is configured for simultaneously matching the antenna impedance and band switching via the second tunable component.

8. The antenna of claim 7, each of the driven antenna element and the at least one parasitic element are further coupled to a switch;

said driven antenna element having a ground leg thereof;

said ground leg and said at least one parasitic element each being coupled to a common port of the switch; and the switch further comprising a plurality of reactive loads attached to two or more switch ports.

9. The antenna of claim 7, each of the driven antenna element and the at least one parasitic element are further coupled to a switch;

said driven antenna element having a ground leg thereof;

said ground leg being coupled to a first port of the switch said at least one parasitic element being coupled to a second port of the switch; and a common port switch being coupled to ground.

10. The antenna of claim 7, each of the driven antenna element and the at least one parasitic element are further coupled to a matching circuit;

said driven antenna element having a ground leg thereof;

said ground leg and said at least one parasitic element each being coupled to the matching circuit; and the matching circuit being further coupled to ground.

11. The antenna of claim 10, said matching circuit comprising at least one active component individually selected from: a tunable capacitor, MEMS device, tunable inductor, switch, or a diode.

12. The antenna of claim 7, said driven antenna element comprising:

an isolated magnetic dipole (IMD) antenna element positioned above a circuit board forming an antenna volume therebetween; and said at least one parasitic element comprising:

a first parasitic element positioned adjacent to said IMD antenna element and within said antenna volume, and a second parasitic element positioned adjacent to the IMD antenna element and outside of the antenna volume.

13. An active modal antenna adapted for impedance matching and band switching using a shared component, the antenna comprising:

a driven antenna element;

said driven antenna element comprising an isolated magnetic dipole (IMD) antenna element positioned above a circuit board forming an antenna volume therebetween; and at least two parasitic elements positioned adjacent to the driven antenna element;

said at least two parasitic elements comprising:

a first parasitic element positioned adjacent to said IMD antenna element and within said antenna volume, and a second parasitic element positioned adjacent to the IMD antenna element and outside of the antenna volume;

characterized in that:

each of the at least two parasitic elements are further coupled to a shared one of: a tunable capacitor, a matching circuit, or a switch;

wherein the antenna is configured for simultaneously matching the antenna impedance and band switching.

14. The antenna of claim 13, each of the at least two parasitic elements being coupled to a first tunable capacitor via transmission lines extending therebetween.

15. The antenna of claim 14, the tunable capacitor being further coupled to a feed leg of the driven antenna element via a transmission line extending therebetween.

16. The antenna of claim 15;

further comprising a matching circuit disposed between the first tunable capacitor and the feed leg of the driven antenna element.

17. The antenna of claim 15;

further comprising a pair of phase compensation circuits each connected between the first tunable capacitor and one of the parasitic elements, respectively, the phase compensation circuits being configured to compensate for the electrical delay between the tunable capacitor and the parasitic elements.

18. The antenna of claim 13, each of the at least two parasitic elements being coupled to a common port of a switch via transmission lines extending therebetween;

said switch further comprising a plurality of reactive loads attached to two or more switch ports;

wherein the common port of the switch is switchably coupled to one of the two or more switch ports to vary a reactance about each of the parasitic elements.

* * * * *